United States Patent [19]

Güttler

[11] Patent Number: 4,720,967

[45] Date of Patent: Jan. 26, 1988

[54] TRANSPORT APPARATUS FOR ROVING BOBBINS FOR A GROUP OF SPINNING MACHINES

[75] Inventor: Hermann Güttler, Uhingen, Fed. Rep. of Germany

[73] Assignee: Zinser Textilmaschinen GmbH, Ebersbach, Fed. Rep. of Germany

[21] Appl. No.: 5,687

[22] Filed: Jan. 21, 1987

[30] Foreign Application Priority Data

Jan. 22, 1986 [DE] Fed. Rep. of Germany ..... 3601832

[51] Int. Cl.[4] ..... D01H 9/02; D01H 9/10; D01H 9/18; B65H 67/04

[52] U.S. Cl. ..... 57/281; 57/1 R; 57/90; 57/266; 198/570; 198/571; 198/601; 242/35.5 A

[58] Field of Search ..... 57/90, 1 R, 266, 276, 57/281, 268; 242/35.5 R, 35.5 A; 198/570–573, 601

[56] References Cited

U.S. PATENT DOCUMENTS

| | | | |
|---|---|---|---|
| 3,195,298 | 7/1965 | Furst | 57/281 X |
| 3,410,406 | 11/1968 | Tsuda et al. | 57/281 X |
| 3,828,682 | 8/1974 | Klein | 57/281 X |
| 3,884,026 | 5/1975 | Yoshizawa et al. | 57/281 |
| 3,973,906 | 8/1976 | Tooka | 57/281 X |
| 3,987,974 | 10/1976 | Mayer | 242/35.5 A |
| 4,583,358 | 4/1986 | Krieger et al. | 57/281 |
| 4,586,326 | 5/1986 | Igel | 57/281 |
| 4,630,435 | 12/1986 | Igel | 57/281 |

FOREIGN PATENT DOCUMENTS

| | | |
|---|---|---|
| 3326000 | 1/1984 | Fed. Rep. of Germany . |
| 3336958 | 4/1984 | Fed. Rep. of Germany . |
| 3240822 | 5/1984 | Fed. Rep. of Germany . |

*Primary Examiner*—John Petrakes

*Attorney, Agent, or Firm*—Karl F. Ross; Herbert Dubno

[57] ABSTRACT

In the transport apparatus for roving bobbins in a plant including a group of spinning machines according to our invention each spinning machine has a closed circulating belt on which suspended carriages equipped either with full or empty roving bobbins are movable. A transport belt is provided which runs through a loading station which replaces empty roving bobbins with full roving bobbins. Each of the circulating belts is connected with the transport belt by one connecting belt for removing one of the suspended carriages with empty roving bobbins and another connecting belt for feeding in another suspended carriage with full roving bobbins. A switch controllable depending on the filling state of the approaching roving bobbin carriage is positioned at each branch of the connecting belts with the transport belt or one of the circulating belts. The roving bobbins are mounted on the transport and circulating belts so as to be movable independently of each other. Drive motion devices are provided which keep the suspended carriages in constant circulation on the transport belt and the circulating belts.

13 Claims, 11 Drawing Figures

TRANSPORT APPARATUS FOR ROVING BOBBINS FOR A GROUP OF SPINNING MACHINES

FIELD OF THE INVENTION

My present invention relates to a transport apparatus or system for roving bobbins in a spinning machine plant or manufacturing unit and, more particularly, to a transport apparatus for roving bobbins for a group of spinning machines in which each spinning machine has a closed circulating path on which a plurality of suspended carriages with full or empty roving bobbins are movable.

BACKGROUND OF THE INVENTION

The bobbin frame of a ring spinning machine is provided with a circulating path by which full roving bobbins are fed to the machine and contrastingly empty roving bobbins are removed as described in German Open Patent Application DE-OS No. 32 40 822. From the circulating path the full bobbins are fed in by hand or by an automatic bobbin exchanging device at the working positions of the roving bobbins in the bobbin frame of the ring spinning machine.

One circulating path system however requires an expensive loading station for each ring spinning machine which is not usually used to capacity with a single ring spinning machine. The problem of input of the roving bobbins from the unit preparing them to the ring spinning machine using them is therefore not solved economically by this known system.

A cap and bobbin transporting unit is known in which cop feed paths and empty bobbin removing paths combine finishing machines and winding spinning machine units in a closed loop or circuit directly with each other (German Open Patent Application DE-OS No. 33 36 958). The cops and empty bobbins transported on the paths are mounted on carrying members. A bobbin supply device which provides an empty carrying member with a bobbin is located in an intermediate position on the bobbin delivery path. This known device acts to feed bobbins to all carrying members feeding the spinning machine and is thus suitable to guarantee a uniform bobbin feed and/or cartridge removal for the units of several ring spinning machines.

Also an additional transport device for different types of cops has been reported. However, this device is not suitable for solution of the above problem (German Open Patent Application DE-OS No. 33 26 000).

OBJECTS OF THE INVENTION

It is an object of my invention to provide an improved transport apparatus for roving bobbins for a group of spinning machines which overcomes drawbacks of the earlier systems.

It is also an object of my invention to provide an improved transport apparatus for roving bobbins for a group of spinning machines to provide a uniform full bobbin feed and an empty cartridge removal for a plant including several spinning machines which guarantees an automatic feed of full roving bobbins and automatic removal of empty roving cartridges where required.

It is also an object of my invention to provide an improved transport apparatus for roving bobbins in a plant including a group of spinning machines which is both simple and economical requiring only a single loading station at which empty bobbins of successive hanging carriages are replaced with full bobbins.

SUMMARY OF THE INVENTION

These objects and others which will become more readily apparent hereinafter are attained in accordace with my invention in a transport apparatus for a plurality of roving bobbins for a group of spinning machines in which each of the spinning machines has a closed circulating path on which a plurality of suspended roving bobbin carriages each either with a plurality of full or empty roving bobbins are movable.

According to my invention a transport path runs by a loading station which replaces empty roving bobbins with full roving bobbins. Each of the circulating paths is connected with the transport path by one connecting path for removing a suspended carriage with empty roving bobbins and another connecting path for feeding in another suspended carriage with full roving bobbins. A switch controllable depending on the filling state of the approaching roving bobbin carriage is positioned at each branch of the connecting paths with the transport path or with the circulating paths. The roving bobbins are mounted on the transport and the circulating paths so as to be movable independently of each other. Drive motion devices are provided which keep the suspended carriages in constant circulation on the transport path and the circulating paths.

As a result of the above structure according to my invention a joint roving bobbin feed and empty cartridge removal for a group of spinning machines coupled in a manufacturing plant or unit is produced. This roving bobbin transport apparatus transports full roving bobbins from a loading station advantageously to a spinning machine, particularly to the circulating path in the frame of a ring spinning machine and the empty roving cartridges are fed back to the loading station.

The transport path for this transport apparatus can be an endless closed path or an open path.

Advantageously the switches are controlled by sensing devices distinguishing between a suspended carriage with full roving bobbins and a suspended carriage with empty roving bobbins. The sensing device associated with one of the switches in one of the circulating paths can be connected also with another of the switches in that circulating path or another of the sensing devices on the transport path. One of the sensing devices can be a weighing device distinguishing between a suspended carriage with full or empty roving bobbins. Also or alternatively the sensing device can include an optical detection unit.

The automatic motion of the suspended carriages on the transport path and on the circulating paths can occur by locally fixed locomotion devices.

The suspended carriages can be kept spaced from each other by spacing plates. The automatic motion of the suspended carriages on the transport path and the circulating paths can occur advantageously by an individual drive on each of the suspended carriages. The individual drive can be an electric motor whose current supply is cut off when adjacent suspended carriages approach too closely to each other. The transport system can have an electrically blocked transport path to prevent too close approximation.

The roving bobbins or suspended carriages are provided with detectors controlling a plurality of switches at the transport path.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
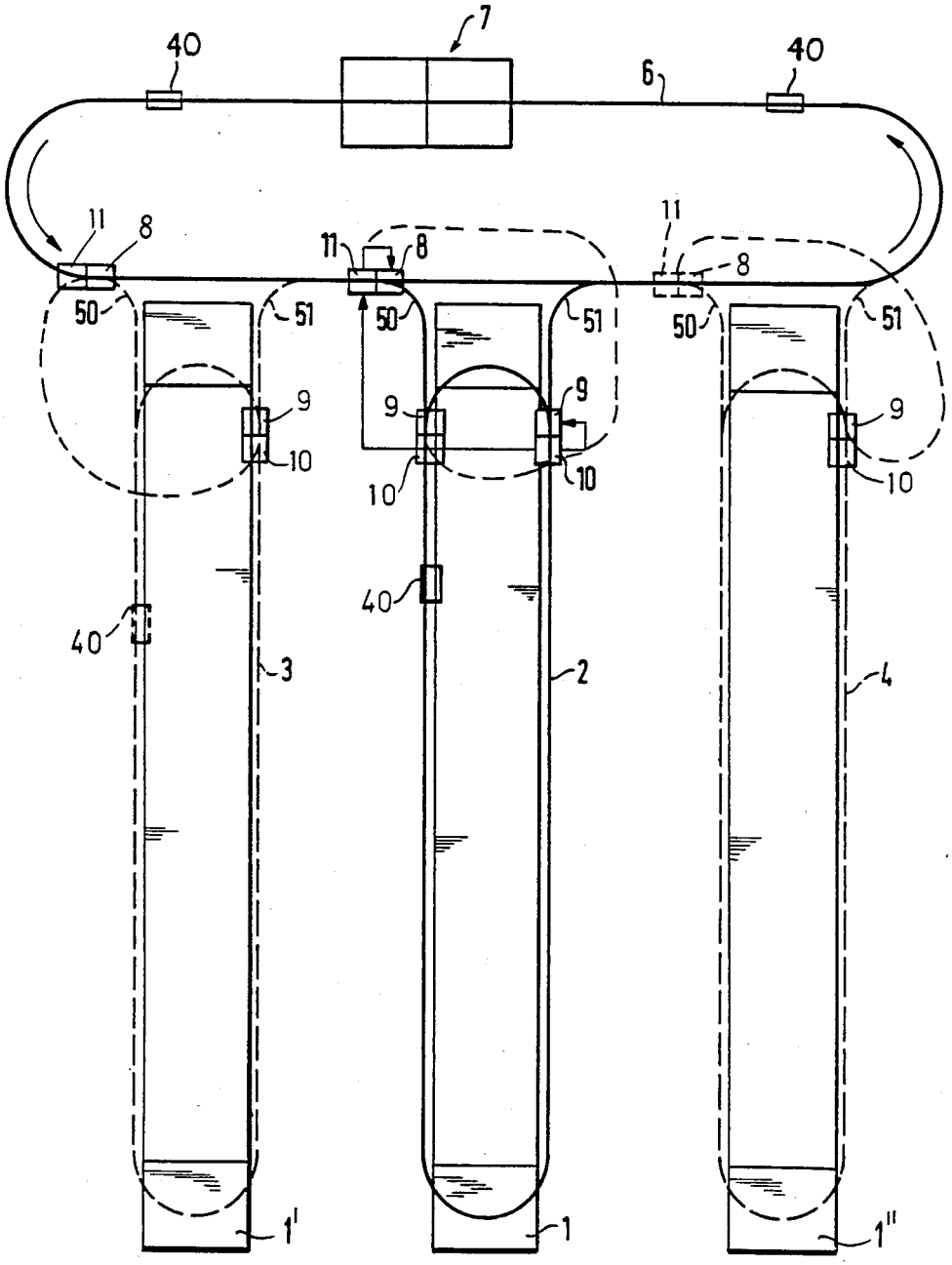
FIGS. 1 and 2 are two top plan schematic views of two different transport apparatuses for roving bobbins according to my invention respectively having a closed or open transport path connected with three spinning machines.
Figure 2:
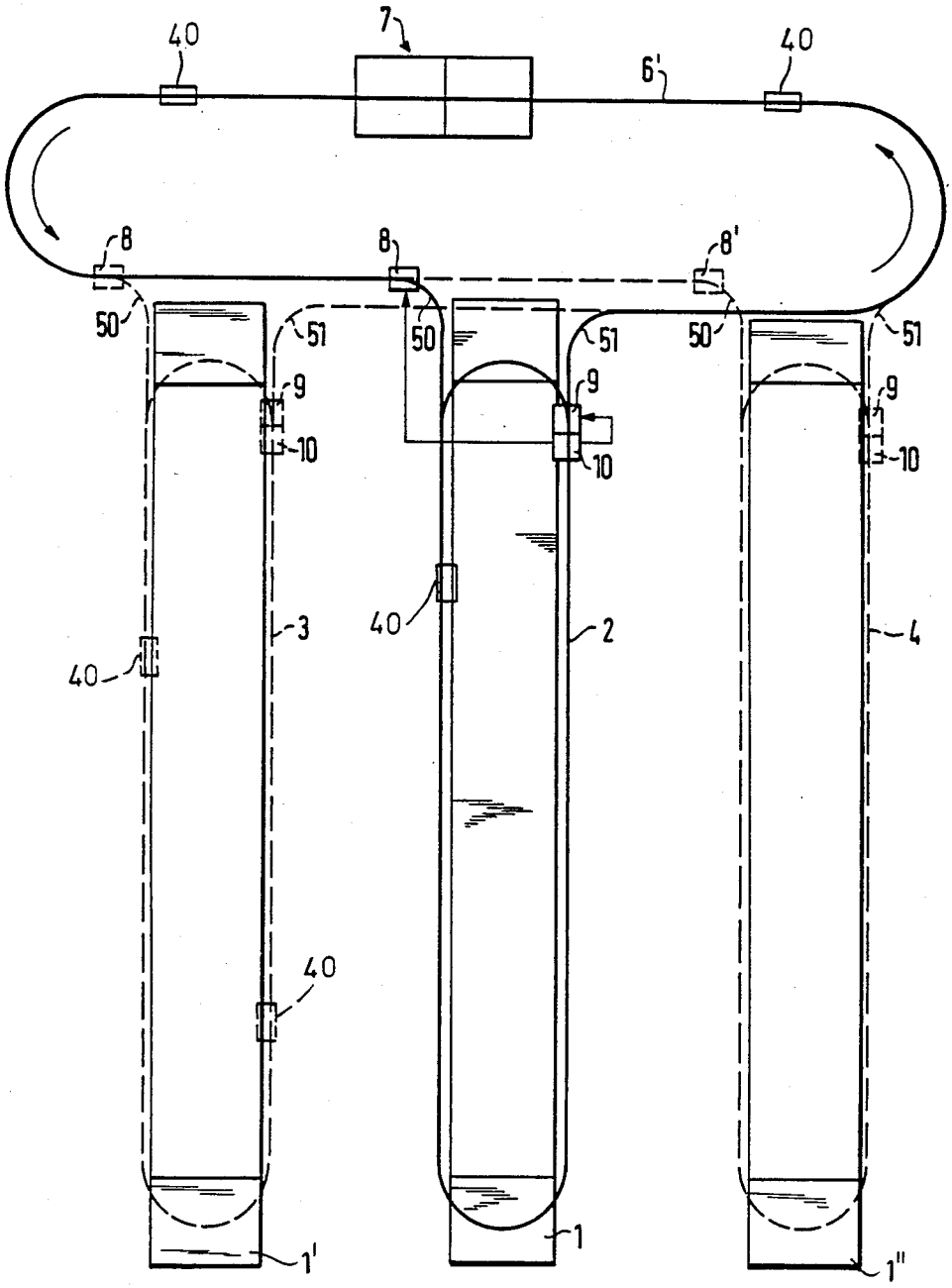

Three spinning machines 1,1',1'', advantageously ring spinning machines, are shown positioned side by side in FIGS. 1 and 2. The central spinning machine 1 is shown with the group of spinning machines 1, 1' and 1''. Each of the spinning machines 1, 1', 1'' positioned parallel to each other is provided with a circulating path 2, 3 and 4. The full roving bobbins from these circulating paths 2, 3 and 4 can be delivered manually or by an automatic bobbin changing device to the roving bobbin delivery positions in the unshown bobbin frame of the spinning machine involved. On these circulating paths 2,3 and 4 suspended roving bobbin carriages are movable equipped with full roving bobbins and/or empty roving bobbins which are guided independently of each other on the circulating paths 2, 3 and 4 and are automatically continuously moved on the circulating paths 2, 3 and 4.

According to FIG. 1 a transport path 6 transverse to these circulating paths 2, 3 and 4 is provided as a closed path. This transport path 6 is connected with a loading station 7. With that the suspended roving bobbin carriages can be automatically continuously moved on the transport path 6 so that empty roving bobbins on the suspended carriages can be substituted with full roving bobbins at the loading station 7.

At the entrance to each circulating path 2, 3 and 4 a switch 8 and a connecting path 50 is provided. Similarly at the outlet of every circulating path 2, 3 and 4 to the transport path 6 a switch 9 as well as a connecting path 51 is provided. The switch 8 is connected upstream of a sensing device 11 and the switch 9 at the outlet of the circulating paths 51 is connected upstream of a sensing device 10.

The sensing device 11 detects whether a full roving bobbin is present on the transport path 6. If this is the case and a need exists for a full roving bobbin on the circulating paths 2, 3 and 4, the switch 8 is set by the sensing device 11 so that the full roving bobbin arrives by the connecting path 50 on the circulating path involved. If there is no need then the full roving bobbin travels further with the aid of the suspended carriage on the transport path 6.

The sensing device 10 detects whether a suspended carriage with full or empty roving bobbins has passed it on the circulating path. If a full roving bobbin is present the switch is set so that the circulating path 2 and/or 3 and/or 4 is closed, i.e. the full roving bobbin continues to wander on the endless circulating path 6. If an empty roving bobbin is present the switch 9 opens and the empty cartridge is taken away by the connecting path 51 to the transport path 6 from which it is removed at the loading station 7.

The closed transport path 6 guides both full and also empty roving bobbins to the vicinity in which it is connected by switches 11 with the circulating paths 2, 3 and 4. Thus the sensing device 10 can be cooperating connected with the sensing device 11, i.e. when the sensing device 10 carries away an empty roving bobbin on the transport path 6, it can communicate this removal of the sensing device 11 as required. Thus when the sensing device 11 detects a suspended carriage with a full roving bobbin the switch is set so that a new suspended carriage carrying a full roving bobbin is brought by the connecting path 50 to the circulating path 2, 3 or 4 involved.

As a result the circulating paths 2, 3 and 4 are automatically supplied with full roving bobbins. On the other hand automatically empty roving bobbins are removed from the suspended carriages at the loading stations 7.

In the embodiment according to FIG. 2 the transport path 6' is an open path. It has a transporting branch only for full roving bobbins feeding from the loading station 7 to the circulating paths 2, 3 and 4 and a transporting branch only for the empty roving bobbins leading from the circulating path of the spinning machine to the loading station 7.

Thus a switch 8 and a connecting strip 50 are provided at the entrance to one of the circulating paths 2 and 3. Furthermore a switch 9 and a connecting path 51 are provided at the outlet of every circulating path and the switch 9 is connected with a sensing device 10.

Should these sensing devices 10 detect an empty roving bobbin, the switch 9 is set in the open position, i.e. the suspended carriage is moved with the empty roving bobbin to the transprot path 6'. Simultaneously this information is transmitted to the switch 8 which is open whereby a suspended carriage with full roving bobbins is transported to the circulating path 2, 3 or 4. The sensing device 10 controls the switches 8 and 9 in this system.

At the end of the transport path 6' a stopping device 8' is positioned instead of the switch 8 which as needed releases a suspended carriage with a full roving bobbin to be fed onto the circulating path 4.

Should the sensing device 10 detect a suspended carriage with full roving bobbins at the outlet of a circulating path the switch 9 remains closed, i.e. the suspended carriage travels on the corresponding circulating path 2 and/or 3 and/or 4; simultaneously also the switch 8 remains closed, i.e. the suspended carriages with full roving bobbins are guided further on the branch of the transport path 6'.

The sensing device 10 senses also whether a passing reverse position contains a suspended carriage with full roving bobbins or a suspended carriage with empty roving bobbins. With a suspended carriage with full roving bobbins the switch 9 is set so that these full roving bobbins remain on the circulating path. With empty roving cartridges or bobbins the switch 8 on the transport path 6' is reversed and leads the suspended carriages with the full roving bobbins by the corresponding connecting strip 50 onto the circulating path to substitute for the empty roving cartridges removed by reversal of the switch 9.

Figure 3:
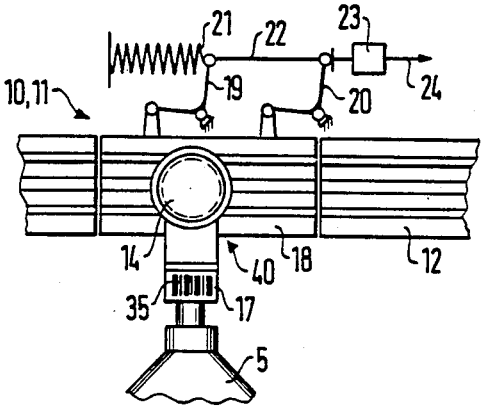
FIG. 3 is a partially cutaway schematic side elevational view of a weighing device or rocker device use as a sensing device.
Figure 4:
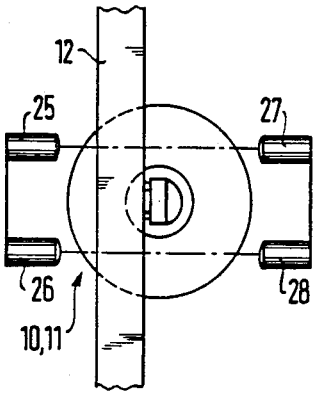
FIG. 4 is a partially cutaway schematic top plan view of an optical measuring device used as a sensing device.

The sensing device 10 and 11 described as to FIGS. 1 and 2 are illustrated in greater detail in FIGS. 3 and 4. One type of sensing device used here is a weighing device according to FIG. 3. This weighing device is mounted on the circulating path 2 and/or 3 and/or 4 and/or the transport path 6. Each of these paths according to FIGS. 3 and/or 5 comprises a rail 12 on which rolls 13 run. Each of these rolls 13 is driven for example by an electric motor 14. Under this unit a bobbin holder 17 is found on which a full roving bobbin 5 is mounted. The roller 13 is connected with commutator brush 15 which receives its energy from a current contact 16 on the inside of the rail 12. The structural units 13, 14, 15 and 17 form all together the suspended carriage 40.

As illustrated in FIG. 3 the rail 12 is interrupted in a region which is formed as a weighing member 18. This weighing member 18 is connected by two pivoting levers 19 and 20 and a connecting lever 22 with a spring 21 on one side and with a computer or analyzer unit 23 on the other side.

If a suspended carriage 40 with a full roving bobbin as shown in FIG. 3 is present, the weighing member 18 drops under the weight of the carriage 40 and the full roving bobbin 5. The pivoting levers 19 and 20 swing in the counterclockwise sense and the spring 21 is correspondingly acted upon to a greater degree than if the suspended carriage 40 had an empty roving bobbin on it. Because of that the analyzer or computer unit operates like a switching circuit and transmits switching signals to the corresponding switches 8 and/or 9 by a conductor 24. In these structures a mechanical device establishes whether the weight of a suspended carriage 40 is above or below a predetermined limit and whether the weighed suspended carriage correspondingly is equipped with an empty or a full roving bobbin.

In the example according to FIG. 4 an optical detection device is used as a sensing device. The optical detection device comprises two light sources 25 and 26 which send out parallel light beams which cooperate with the detectors 27 and 28. The spacing of the light sources 25 and 26 from each other is such that an additional signal is sent out when a suspended carriage with a full roving bobbin 5 is present instead of one with an empty roving cartridge. This output signal of the measuring detector 10 and/or 11 is transmitted on the switches 8 and/or 9 at the outlet and inlet of the transport paths 6 and/or 6' to the circulating paths 2, 3 and 4.

Figure 5:
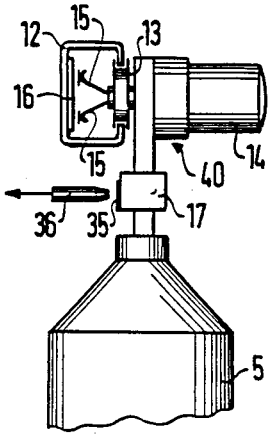
FIG. 5 is a partially cutaway side elevational view of a drive for a suspended carriage.

The feeding of the suspended carriages with full roving bobbins 5 and the removal of suspended carriages with empty roving bobbins on the transport paths 6 and/or 6' and on the circulating paths 2,3 and 4 can occur mechanically or electrically. As shown in FIG. 5 an electric motor 14 is used which transports the suspended carriages 40 by the roller 13. The required electrical energy is, as set forth previously, taken by a commutator brush 15 from the current rail 12 in contact with a current contact 16 on the interior of the rail 12. The required spacing between the individual suspended carriages can be guaranteed by deenergizing the electric motor 14 when the carriages approach one another.

The possibility exists for an electrical operative connection of the circulating paths 2, 3 and 4, i.e. a division into a plurality of current flow sections of which each is provided with current when the subsequent section of the previous bobbin position is empty.

Figure 6:
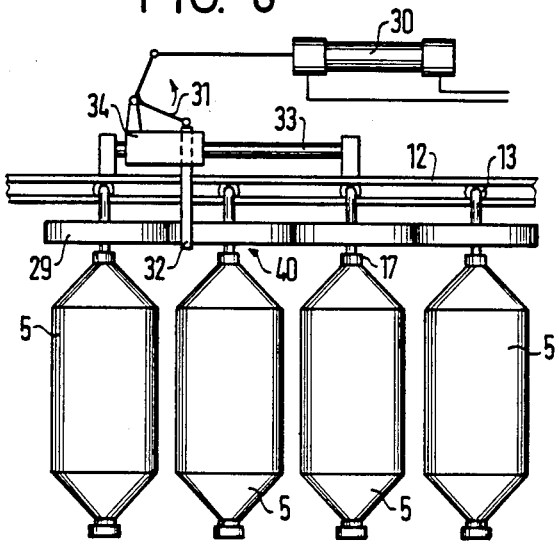
FIG. 6 is a partially cutaway schematic slider device for transport of full roving bobbins.
Figure 7:
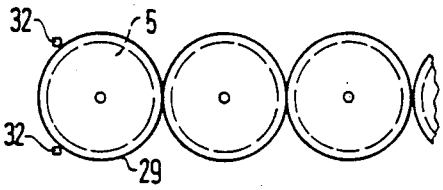
FIG. 7 is a top plan view of the structure according to FIG. 6 shown simplifiied.
Figure 8:
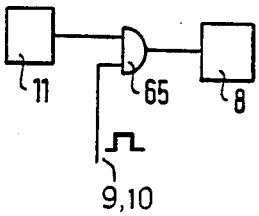
FIGS. 8 to 11 are electrical circuit diagrams for different possible activating circuits for the transport apparatus of my invention.

In an additional embodiment according to FIGS. 6 and 7 every suspended carriage 40 is provided with a spacing plate 29. Here instead of an electric motor 14 a mechanical sliding device, i.e. a locally fixed locomotion device, is used.

Each of these sliding devices comprises a fork 32 which can engage the spacing plate 29. This fork 32 is attached to a carriage 34 which can slide on a carriage guide 33. A bent lever 31 is provided on the carriage 34 which is attached with the piston rod of a piston-cylinder-device 30. It and also the carriage 34 can be raised by the bent lever 31 so that by this motion the fork 32 comes into or out of engagement with the outer sides of the spacing plate 29.

In the position shown in FIG. 6 the fork 32 is in engagement with the spacing plate 29. If the piston-cylinder-unit 30 operates the spacing plate 29 is pushed from left to right and of course in a stroke approximately corresponding to the length of the carriage guide 33 and the piston stroke of the piston-cylinder-unit 30. After that the carriage 34 pivots by the bent lever 31 from the engaged position and is pulled back by operation of the piston-cylinder-unit 30 into its initial position.

The suspended carriages 40 with the full roving bobbins 5 and/or with the empty roving bobbins move further through this mechanical transport device so that the spacing of the individual suspended carriages is guaranteed by the spacing plate 29.

It is also possible that yarn of different properties can be worked in different ring spinning machines of the group. According to FIGS. 3 and 5 an optical detection 35 is provided at the bobbin holder 17 of the suspended carriage 40 which is detectable by a reader 36 according to FIG. 5. The optical detection 35 responds to the yarn quality of the yarn bobbin 5 associated with the suspended carriage 40.

In the loading station 7 the bobbin holder of the suspended carriage is provided with corresponding roving bobbins and simultaneously detection occurs. This detection is accomplished by the reader 36 in the sensing device 11 so that the switches 8 in the transport path 6 and/or 6' are set and only then the switches for feeding the circulating paths 2,3 and 4 are set when the roving of the kind worked in the spinning machine is to be put in place.

Thus the suspended carriages with a bobbin with roving of different qualities and/or properties advantageously are transported over the transport paths 6 and/or 6' so that an exact control of the corresponding spinning machine occurs at the corresponding optical detector 35 on the bobbin holder 17. It is also possible to provide the roving bobbins 5 with appropriate detectors.

In the embodiment according to FIGS. 8 to 11 the transport path 6 or 6' and the circulating paths 2, 3 and 4 cooperate electrically. When a sensing device 10 detects a suspended carriage 40 with an empty roving bobbin cartridge on circulating path 2, it transmits a positioning pulse to the switch 9 to conduct away this empty roving bobbin cartridge over the connecting path 51 to the transport path 6 or 6'. This pulse simultaneously according to FIG. 8 goes to an and-gate 65 which retransmits it as a positioning pulse to the switch 8 in the transport path 6, 6' when also a signal is applied to the and-gate 65 by the sensing device 11 in the transport path 6, 6' which signals the "full bobbin" and/or "the correct roving properties38 . Now with both pulses present the switch 8 in the transport path 6 reverses so that it exchanges the empty roving bobbin by insertion of a full roving bobbin.

Figure 9:
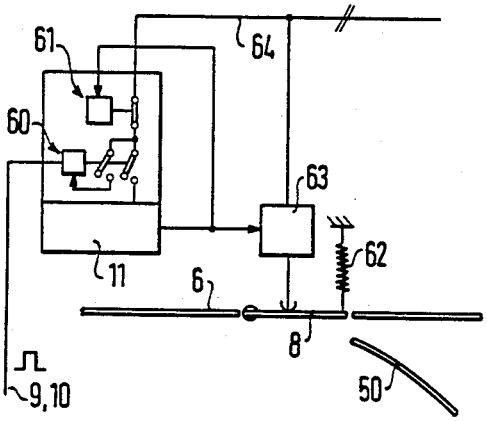

According to FIG. 9 the pulse from the switch 9 and/or the sensing device 10 closes the contacts of a switch 60. Thus the sensing device 11 is in the electrical net 64 and is activated. By the contacts held together in the switch 60 this switch is closed, but also after the decay of the pulse from the switch 9 and/or the sensing device 10.

As soon as the sensing device 11 detects a full roving bobbin 5 it transmits a pulse to an operating device 63 for the switch 8 which is pivoted by that against the action of the spring 62 to the connecting path 50 and thus the suspended carriages with the full roving bobbins 5 travels to the path 50. This positioning impulse is conducted to a switch 61 which opens and which lets the switch 60 open.

Figure 10:
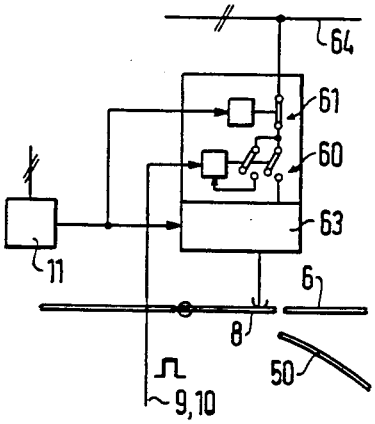

In the embodiment according to FIG. 10 the switches 60 and 61 are provided so that the operating device 63 is activated by them. Then in the way previously described the switch 8 can be similarly pivoted to the connecting path 50.

Figure 11:
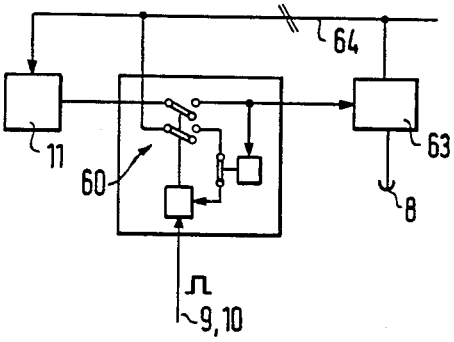

In the embodiment according to FIG. 11 the same switch arrangement as in the embodiments according to FIGS. 9 and 10 is provided for signal conduction between the sensing device 11 and the switch 8. The sensing device 11 or the switch 8 is not in this case in the net 64 and does not activate it, but allows or stops the further transmission of positioning pulses from the sensing device 11 to the switch 8. The held together contacts of the switch 60 shows a kind of memory which keeps a required impulse for a full roving bobbin from the switch 9 and/or the sensing device 10 effective until it is processed. The device is such that an additional pulse which is input, as long as the switch 60 is closed automatically, decays. In this way an erroneously full roving bobbin must subsequently be fed by hand if an expensive state of the art memory switch is not used which handles each required impulse until it is filled.

By the present invention it is guaranteed that several spinning machines provided with circulating paths have a single individual bobbin feed and sleeve or core removal unit. By the switches 8 and 9 and by the sensing devices 10 and 11 the correct input of full roving bobbins to the spinning machine and removal of empty roving bobbins by the corresponding suspended carriages from the circulating paths is satisfactorily guaranteed.

I claim:

1. A transport apparatus for a plurality of roving bobbins for a group of spinning machines comprising:

a closed circulating path for each of said spinning machines;

a plurality of suspended roving bobbin carriages movable independently of each other each equipped either with full or empty roving bobbins which are movable along each of said closed circulating paths;

a loading station from which a plurality of said full roving bobbins are deliverable;

a transport path w ich runs through said loading station which replaces at least one of said empty roving bobbins on said suspended carriages with at least one of said full roving bobbins;

a plurality of connecting paths connecting said transport path with each of said circulating paths so as to remove said suspended carriages with said empty roving bobbins from and feed said suspended carriages with said full roving bobbins to said circulating paths;

a switch controllable depending on the filling state of the approaching one of said suspended carriages being positioned at each branch of said connecting paths with said transport bath or with said circulating paths; and a plurality of drive motion devices which keep said suspended carriages in constant circulation on said transport path and said circulating paths.

2. The apparatus according to claim 1 wherein said transport path is an endless closed path.

3. The apparatus according to claim 1 wherein said transport path is an open path.

4. The apparatus according to claim 1 further comprising a plurality of sensing devices distinguishing between said suspended carriages with said full roving bobbins and said suspended carriages with said empty roving bobbins, said sensing devices being connected to said switches for control thereof.

5. The apparatus according to claim 4 wherein said sensing device associated with one of said switches of one of said circulating paths is connected also with another of said switches in said one of said circulating paths or another of said sensing devices in said transport path.

6. The apparatus according to claim 4 wherein each of said sensing devices is a weighing device.

7. The apparatus according to claim 4 wherein each of said sensing devices is an optical detection unit.

8. The apparatus according to claim 1 further comprising locally fixed locomotion devices to effect the automatic motion of said suspended carriages in said transport path and in said circulating paths.

9. The apparatus according to claim 1 further comprising a plurality of spacing plates so that said suspended carriages are kept spaced apart from each other.

10. The apparatus according to claim 1 further comprising an individual drive on each of said suspended carriages to effect the automatic motion of said suspended carriages on said transport path and said circulating paths.

11. The apparatus according to claim 10 wherein said individual drive comprises an electric motor and a means for cutting off a current supply to said motor when adjacent ones of said suspended carriages approach too closely to each other.

12. The apparatus according to claim 10 further comprising detectors provided on said roving bobbins or said suspended carriages for controlling a plurality of said switches in said transport paths.

13. A transport apparatus for a plurality of roving bobbins for a group of spinning machines comprising:

a closed circulating path for each of said spinning machines;

a plurality of suspended roving bobbin carriages movable independently of each other each equipped either with full or empty roving bobbins which are movable along each of said closed circulating paths;

a loading station from which a plurality of said full roving bobbins are deliverable;

a closed transport path which runs through said loading station which replaces at least one of said empty roving bobbins on said suspended carriages with at least one of said full roving bobbins;

a plurality of connecting paths connecting said transport path with each of said circulating paths so as to remove said suspended carriages with said empty roving bobbins from and feed said suspended carriages with said full roving bobbins to said circulating paths;

a switch controllable depending on the filling state of the approaching one of said suspended carriages being positioned at each branch of said connecting paths with said transport path or with said circulating paths;

a plurality of sensing devices including at least one weighing device distinguishing between said suspended carriages with said full roving bobbins and said suspended carriages with said empty roving bobbins connected to said switches for control thereof; and a plurality of drive motion devices each comprising an electric motor mounted on each individual one of said suspended carriages which keep said suspended carriages in constant circulation on said transport path and said circulating paths.

* * * * *